US008915769B2

(12) United States Patent
Kamikihara et al.

(10) Patent No.: US 8,915,769 B2
(45) Date of Patent: Dec. 23, 2014

(54) METHOD OF MANUFACTURING TUBULAR STRUCTURE, AND STENT

(75) Inventors: Kazutaka Kamikihara, Miyagi (JP); Kiyoshi Yamauchi, Miyagi (JP); Katsuhiko Komatsu, Nagano (JP); Shinyou Tanaka, Nagano (JP)

(73) Assignees: Clino Corporation, Miyagi (JP); Kyoei Denko Co., Ltd., Nagano (JP)

( * ) Notice: Subject to any disclaimer, the term of this patent is extended or adjusted under 35 U.S.C. 154(b) by 718 days.

(21) Appl. No.: 13/202,012

(22) PCT Filed: Feb. 17, 2010

(86) PCT No.: PCT/JP2010/052376

§ 371 (c)(1),
(2), (4) Date: Aug. 17, 2011

(87) PCT Pub. No.: WO2010/095664

PCT Pub. Date: Aug. 26, 2010

(65) Prior Publication Data

US 2011/0301691 A1 Dec. 8, 2011

(30) Foreign Application Priority Data

Feb. 17, 2009 (JP) ..... 2009-034489

(51) Int. Cl.
*B24B 1/00* (2006.01)
*B24B 5/40* (2006.01)
*B24B 31/112* (2006.01)

(52) U.S. Cl.
CPC . *B24B 1/005* (2013.01); *B24B 5/40* (2013.01); *B24B 31/112* (2013.01)
USPC ..... 451/29; 451/37; 451/51; 451/57; 451/61

(58) Field of Classification Search
USPC ..... 134/7, 8, 22.11, 22.18, 23; 451/36, 37, 451/51, 57, 60, 61, 29; 623/23.7, 1.15
See application file for complete search history.

(56) References Cited

U.S. PATENT DOCUMENTS 4,175,930 A * 11/1979 Sakulevich et al. ..... 451/36
4,821,466 A * 4/1989 Kato et al. ..... 451/36

(Continued)

FOREIGN PATENT DOCUMENTS

JP 54-058297 5/1979
JP 63221965 A * 9/1988 ..... B24B 31/112

(Continued)

OTHER PUBLICATIONS

Decision of Patent Grant of JP 2011-500637 dated Nov. 19, 2013 with English translation.

*Primary Examiner* — Timothy V Eley
(74) *Attorney, Agent, or Firm* — McDermott Will & Emery LLP.

(57) ABSTRACT

A method of manufacturing a tubular structure is implemented by housing a tubular base, which has a side circumference surface formed in a bellows-like shape, in a polishing container, causing magnetic particles to flow along a circumferential direction of the tubular base due to action of magnetic poles, and supplying abrasive particles to the polishing container so that the abrasive particles flow along an axial direction of the tubular base, thereby polishing a surface of the tubular base. The method includes: a first polishing step of polishing an exposed surface of the tubular base by causing the magnetic particles and the abrasive particles to flow while an inner surface of the tubular base remains covered; and a second polishing step of polishing an exposed surface of the tubular base by causing the magnetic particles and the abrasive particles to flow while an outer surface of the tubular base remains covered.

7 Claims, 4 Drawing Sheets

(56) References Cited

U.S. PATENT DOCUMENTS

| | | | | |
|---|---|---|---|---|
| 5,813,901 | A * | 9/1998 | Kremen | 451/28 |
| 6,146,245 | A * | 11/2000 | Kremen et al. | 451/36 |
| 6,183,353 | B1 * | 2/2001 | Frantzen | 451/104 |
| 6,688,949 | B2 * | 2/2004 | Shinbo et al. | 451/51 |
| 8,641,477 | B2 * | 2/2014 | Harder | 451/36 |
| 8,708,778 | B2 * | 4/2014 | Greenslet | 451/51 |
| 8,728,563 | B2 * | 5/2014 | Palmaz et al. | 427/2.24 |
| 2002/0119738 | A1 | 8/2002 | Shinbo et al. | |
| 2003/0216109 | A1 * | 11/2003 | Riviere et al. | 451/36 |
| 2005/0263171 | A1 | 12/2005 | Wu et al. | |
| 2007/0233234 | A1 | 10/2007 | Moriuchi | |
| 2010/0305682 | A1 * | 12/2010 | Furst | 623/1.13 |

FOREIGN PATENT DOCUMENTS

| | | |
|---|---|---|
| JP | 2002-254292 | 9/2002 |
| JP | 2006-247140 A | 9/2006 |
| JP | 2007-267844 | 10/2007 |
| JP | 2007-528301 | 10/2007 |
| JP | 2008-067924 A | 3/2008 |

* cited by examiner

METHOD OF MANUFACTURING TUBULAR STRUCTURE, AND STENT

RELATED APPLICATIONS

This application is the U.S. National Phase under 35 U.S.C. §371 of International Application No. PCT/JP2010/052376, filed on Feb. 17, 2010, which in turn claims the benefit of Japanese Application No. 2009-034489, filed on Feb. 17, 2009, the disclosures of which Applications are incorporated by reference herein.

TECHNICAL FIELD

The present invention relates to a method of manufacturing a tubular structure and a stent. In particular, the present invention relates to a method of manufacturing a tubular structure by housing a tubular base, which has a side circumference surface formed in a bellows-like shape, in a polishing container and by polishing the surface of the housed tubular base with magnetic particles and abrasive particles. The present invention also relates to a stent that is manufactured by this method.

BACKGROUND ART

A stent, which is also generally called a lumen expanding device, is a medical device that is formed by performing a polishing process, such as magnetic polishing, on a stent base that is formed such that a tubular body, which is made of material having high expansive force and high restoring properties, is subjected to laser cutting so that incisions are made on a side circumference surface of the tubular body in order that expansive force is given in a radially outward direction and whereby the side circumference surface is formed into a bellows-like shape.

Such a stent is mounted in a compressed manner, for example, inside a catheter or on a balloon at the tip of a catheter so that a diameter of the stent becomes tapered. When the catheter reaches a constriction region in a blood vessel, the stent is pushed out from the tip of the catheter, expands together with the constriction region in the blood vessel due to the self-restoring property or by the balloon at the tip of the catheter, and remains placed at this region.

Meanwhile, the following method has been known as an example of the above-mentioned magnetic polishing method. For example, there is a method of manufacturing a stent by housing a stent base in a polishing container; causing magnetic particles, which are formed of a magnetic substance and sealed inside the polishing container, to flow along a circumferential direction of the stent base due to the action of magnetic poles arranged outside the polishing container; and supplying abrasive particles, which are formed of a non-magnetic substance, along an axial direction of the stent base from an external supply source, thereby polishing a surface of the stent base. According to the above method, it is possible to polish the surface of the stent base in a good state and to manufacture a stent with good surface smoothness (see, for example, Patent Literature 1).

CITATION LIST

Patent Literature

Patent Literature 1: Japanese Laid-open Patent Publication No. 2002-254292

SUMMARY OF INVENTION

Technical Problem

However, in the method proposed in the above-mentioned Patent Literature 1, because the surface of the stent base that is exposed inside the polishing container is polished with the magnetic particles and the abrasive particles, the entire surface of a stent 200 is approximately uniformly polished as illustrated in FIG. 8. Therefore, a cross-sectional area of a strut portion 210 of the stent 200 becomes an approximate square, or an outer surface of the strut portion becomes slightly smaller than an inner surface of the strut portion. Therefore, it is difficult to perform microfabrication (that is, a process of changing a shape of a structural region of the stent) while polishing the surface. The stent is explained above as an example of the tubular structure; however, it goes without saying that the same problem may occur in various other tubular structures in addition to the stent.

The present invention has been made in view of the above, and it is an object of the present invention to provide a method of manufacturing a tubular structure capable of appropriately polishing a surface of a tubular structure and performing microfabrication for changing a shape of a structural region of the tubular structure, and to provide a stent.

Solution to Problem

According to one aspect, there is provided a method of manufacturing a tubular structure by housing a tubular base, which has a side circumference surface formed in a bellows-like shape, in a polishing container, causing magnetic particles formed of a magnetic substance to flow along a circumferential direction of the tubular base due to action of magnetic poles arranged outside the polishing container, and supplying abrasive particles formed of a non-magnetic substance to the polishing container by a supplying means arranged outside the polishing container so that the abrasive particles flow along an axial direction of the tubular base, thereby polishing a surface of the tubular base, the method including: a first polishing step of polishing an exposed surface of the tubular base by causing the magnetic particles and the abrasive particles to flow while an inner surface of the tubular base remains covered; and a second polishing step of polishing an exposed surface of the tubular base by causing the magnetic particles and the abrasive particles to flow while an outer surface of the tubular base remains covered.

In the method, a polishing condition may be changed between the first polishing step and the second polishing step.

In the method, a process time may be changed between the first polishing step and the second polishing step.

In the method, magnitude of magnetic force may be changed between the first polishing process and the second polishing process.

In the method, a process time of the second polishing step may be longer than a process time of the first polishing step.

In the method, each of the first polishing step and the second polishing step may include a step of moving at least one of the magnetic poles and the polishing container while the magnetic poles are relatively displaced with respect to the tubular base along the axial direction of the tubular base.

In the method, at each of the first polishing step and the second polishing step, a time taken to polish end portions of the tubular base by moving the magnetic poles to positions corresponding to the end portions may be longer than a time taken to polish a central portion of the tubular base by moving the magnetic poles to a position corresponding to the central portion.

According to another aspect, a stent is manufactured by the above-mentioned method.

Advantageous Effects of Invention

According to the present invention, there includes a first polishing process, in which an exposed surface of a tubular base is polished by causing magnetic particles and abrasive particles to flow while an inner surface of the tubular base remains covered, and a second polishing process, in which an exposed surface of the tubular base is polished by causing the magnetic particles and abrasive particles to flow while an outer surface of the tubular base remains covered. Therefore, by adjusting a time required for the first polishing process and a time required for the second polishing process, or by adjusting a region to be polished in the first polishing process and a region to be polished in the second polishing process, it is possible to polish the surface of the tubular structure in a good state and it is also possible to perform microfabrication for changing a shape of a structural region of the tubular structure.

DESCRIPTION OF EMBODIMENTS

Preferred embodiments of a method of manufacturing a tubular structure and a stent according to the present invention will be explained in detail below with reference to the accompanying drawings. In the following embodiments, a stent will be explained as an example of the tubular structure.

Figure 1:
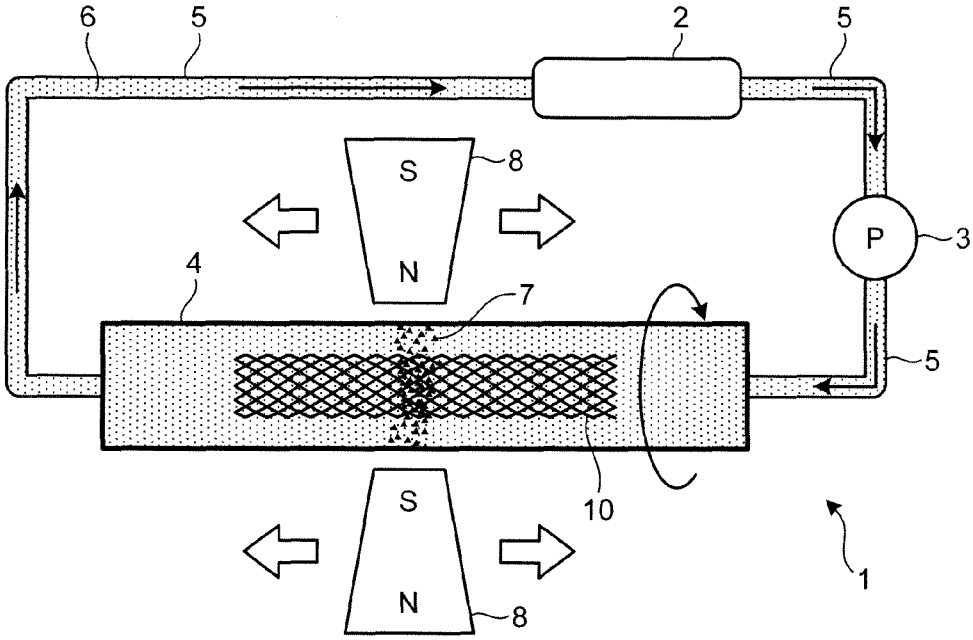
FIG. 1 is a schematic diagram of a polishing apparatus for implementing a method of manufacturing a stent (a tubular structure) according to an embodiment of the present invention.

FIG. 1 is a schematic diagram of a polishing apparatus for implementing a method of manufacturing a stent (a tubular structure) according to an embodiment of the present invention. An exemplary polishing apparatus 1 is configured to serially connect an abrasive particle tank 2, a pump 3, and a polishing container 4 via a pipe 5.

The abrasive particle tank 2 stores therein abrasive particles 6. More specifically, the abrasive particles 6 in the form of slurry, which is a mixture of diamond, aluminum oxide, or silicon nitride in oil, are accumulated in the abrasive particle tank.

The pump 3 is a supplying means that sucks in and discharges the abrasive particles 6, which are in the form of slurry and accumulated in the abrasive particle tank 2, in order to circulate the abrasive particles 6 through the polishing container 4 and the abrasive particle tank 2 in turn via the pipe 5 as indicated by arrows in FIG. 1, thereby supplying the abrasive particles 6 to the polishing container 4.

The polishing container 4 is a cylindrical container with openings at both ends. The openings are connected to the pipe 5. A stent base (a tubular base) 10 is fixedly supported inside the polishing container 4. The stent base 10 is formed such that a tubular body, which is made of flexible material having restoring force, such as stainless steel, cobalt-chrome (Co—Cr) alloy, or titanium nickel (Ti—Ni) alloy, is subjected to laser cutting so that incisions are made on a side circumference surface of the tubular body in order that expansive force is given in a radially outward direction and whereby the side circumference surface is formed into a bellows-like shape.

Magnetic particles 7 formed of a magnetic substance, such as iron, nickel, or specially-treated stainless, are sealed inside the polishing container 4. The polishing container 4 is rotatable around a shaft center on the assumption that a central axis of the polishing container functions as the shaft center, though not illustrated.

Magnetic poles 8 as magnetic-force generation sources are arranged outside the polishing container 4. The magnetic poles 8 are arranged such that portions of the magnetic poles 8 face each other across the polishing container 4 and have opposite polarities. The magnetic poles 8 are slidable along an axial direction of the polishing container 4, though not illustrated. As the magnetic-force generation source, a permanent magnet or an electromagnet may be applied, and the magnitude of the magnetic force can be changed appropriately.

Figure 2:
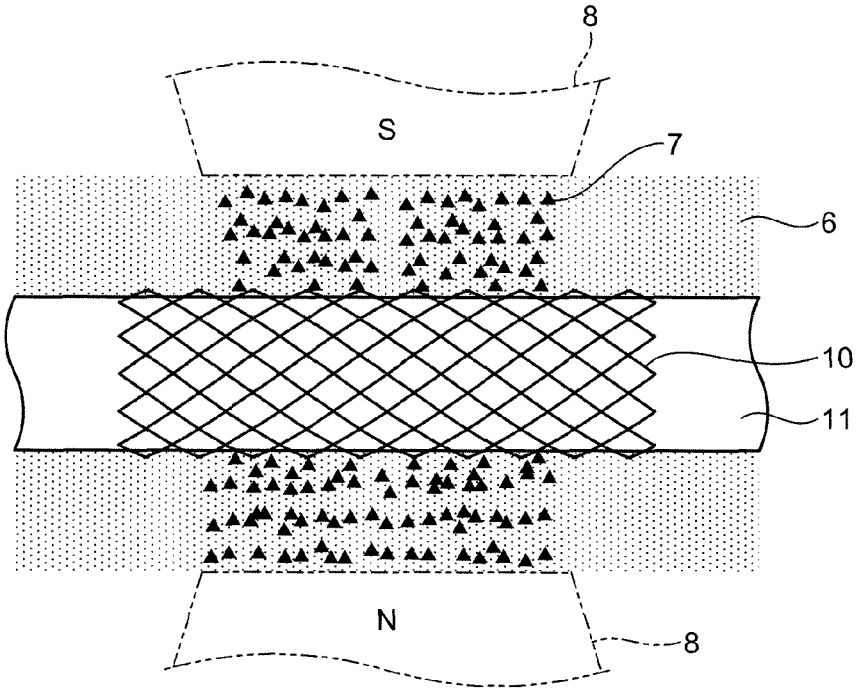
FIG. 2 is an explanatory diagram schematically illustrating the interior of a polishing container in a first polishing process.
Figure 3:
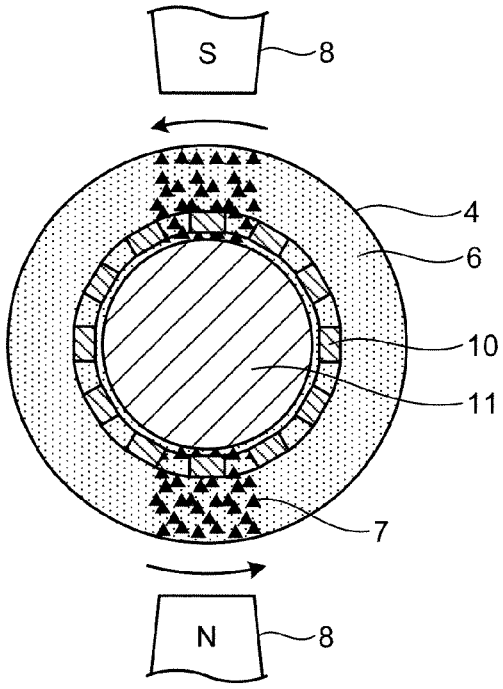
FIG. 3 is a vertical cross-sectional view schematically illustrating the interior of the polishing container in the first polishing process.

With use of the polishing apparatus 1, a stent 20 (see FIG. 6) is manufactured from the stent base 10 in the following manner. First, the stent base 10 is placed in the polishing container 4. Various ways of placement may be applicable; however, according to the embodiment, as illustrated in FIGS. 2 and 3, a long columnar rod member 11 is inserted into a hollow of the stent base 10 so that the stent base can be fixedly supported and placed inside the polishing container 4. The rod member 11 has an outer diameter that matches an inner diameter of the stent base 10 or that is slightly smaller than the inner diameter of the stent base, and the length of the rod member in the axial direction is sufficiently longer than that of the stent base 10. By inserting the rod member 11 into the stent base 10 as above, an inner surface of the stent base 10 can be covered with the rod member 11.

After the stent base 10 is fixedly supported as above, the polishing container 4 is rotated around the shaft center of the polishing container 4, and at the same time, the pump 3 is activated. Accordingly, the magnetic particles 7 and the abrasive particles 6 that are in the form of slurry and carried between the magnetic particles 7 are caused to flow through and polish a predetermined region of an exposed surface of the stent base 10 (a first polishing process). At this time, the magnetic poles 8 are slightly reciprocated along the axial direction of the polishing container 4, so that the exposed surface of the stent base 10 can be effectively polished.

After the predetermined region is polished, the magnetic poles 8 are moved along the axial direction of the polishing container 4, that is, the magnetic poles 8 are moved along the axial direction of the stent base 10 so as to be relatively displaced with respect to the stent base 10, and the polishing container 4 is again rotated around the shaft center of the polishing container 4 while the pump 3 is again activated, so that another region of the exposed surface of the stent base 10 is polished. At this time, the magnetic poles 8 are again slightly reciprocated along the axial direction of the polishing container 4, so that the exposed surface of the stent base 10 can be effectively polished.

After the above operation is repeated and polishing of the exposed surface of the stent base 10 with the inner surface remaining covered is completed, the pump 3 is deactivated and the rotation of the polishing container 4 is stopped.

Figure 4:
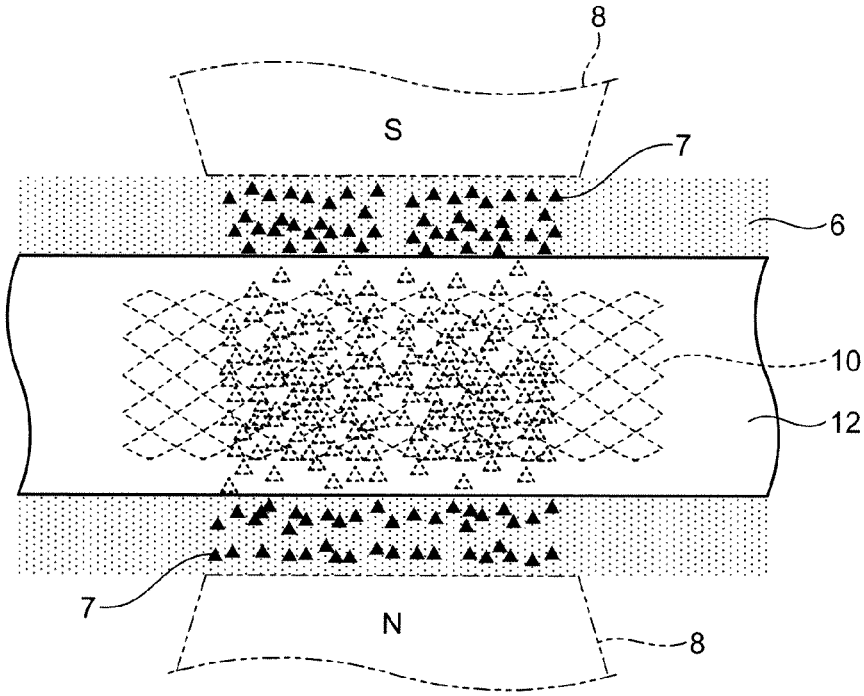
FIG. 4 is an explanatory diagram schematically illustrating the interior of the polishing container in a second polishing process.
Figure 5:
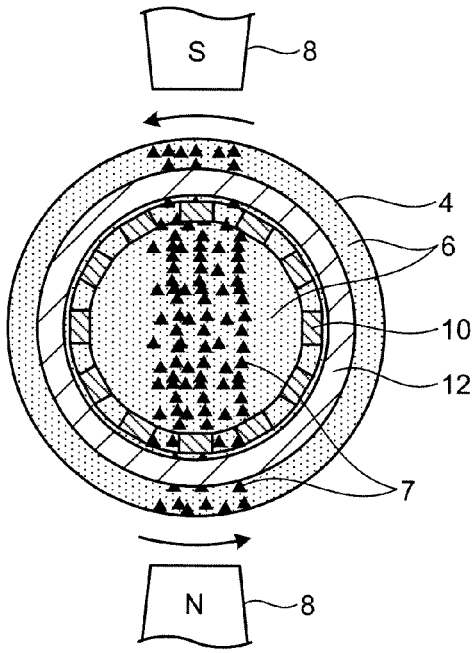
FIG. 5 is a vertical cross-sectional view schematically illustrating the interior of the polishing container in the second polishing process.

Thereafter, as illustrated in FIGS. 4 and 5, the stent base 10 is moved into a hollow of a cylindrical member 12, which is in the form of a long cylinder, so that the stent base can be fixedly supported and placed inside the polishing container 4. The cylindrical member 12 has an inner diameter that matches the outer diameter of the stent base 10 or is slightly larger than the outer diameter of the stent base, and the length of the cylindrical member in the axial direction is sufficiently longer than the stent base 10. By inserting the stent base 10 into the hollow of the cylindrical member 12, the outer surface of the stent base 10 is covered with the cylindrical member 12.

After the stent base 10 is fixedly supported as above, the polishing container 4 is rotated around the shaft center of the polishing container 4, and at the same time, the pump 3 is activated. Accordingly, the magnetic particles 7 and the abrasive particles 6 that are in the form of slurry and carried between the magnetic particles 7 are caused to flow through and polish a predetermined region of an exposed surface of the stent base 10 (a second polishing process). At this time, the magnetic poles 8 are slightly reciprocated along the axial direction of the polishing container 4, so that the exposed surface of the stent base 10 can be efficiently polished. In particular, it is preferable that a process time of the second polishing process should be longer (more specifically, approximately twice longer) than that of the first polishing process.

After the predetermined region is polished, the magnetic poles 8 are moved along the axial direction of the polishing container 4, that is, the magnetic poles 8 are moved along the axial direction of the stent base 10 so as to be relatively displaced with respect to the stent base 10, and the polishing container 4 is again rotated around the shaft center of the polishing container 4 while the pump 3 is again activated, so that another region of the exposed surface of the stent base 10 is polished. At this time, the magnetic poles 8 are again slightly reciprocated along the axial direction of the polishing container 4, so that the exposed surface of the stent base 10 can be effectively polished.

After the above operation is repeated and polishing of the exposed surface of the stent base 10 with the outer surface remaining covered is completed, the pump 3 is deactivated and the rotation of the polishing container 4 is stopped. As a result, the stent 20 is manufactured.

According to the above manufacturing method, there includes the first polishing process, in which the exposed surface of the stent base 10 is polished by causing the magnetic particles 7 and the abrasive particles 6 to flow while the inner surface of the stent base 10 remains covered, and the second polishing process, in which the exposed surface of the stent base 10 is polished by causing the magnetic particles 7 and the abrasive particles 6 to flow while the outer surface of the stent base 10 remains covered. Therefore, by adjusting a time required for the first polishing process and a time required for the second polishing process, or by adjusting a region to be polished by the first polishing process and a region to be polished by the second polishing process, it is possible to polish the surface of the stent 20 in a good state and it is also possible to perform microfabrication for changing the shape of a structural region of the stent 20.

Figure 6:
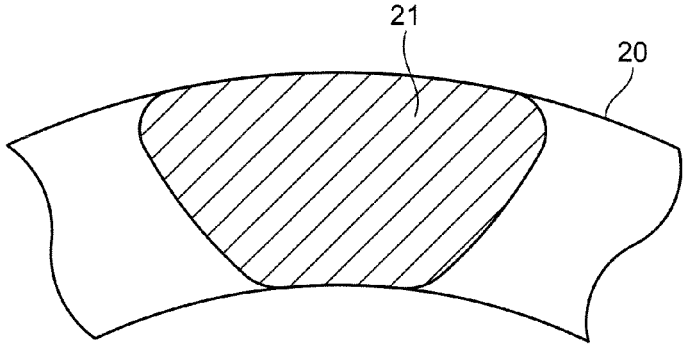
FIG. 6 is an enlarged vertical cross section of a main part of a stent that is manufactured by the manufacturing method according to the embodiment of the present invention.

In particular, if the process time of the second polishing process is longer (approximately twice longer) than that of the first polishing process, the outer surface of a strut portion 21 of the stent 20 can be larger than the inner surface of the strut portion as illustrated in FIG. 6. The stent 20 with the strut portion 21 as above is advantageous in that, when the stent is expanded and placed at a constriction region in a blood vessel, a contact area with an inner wall surface of the blood vessel can be sufficiently ensured while a contact area with a blood stream can be reduced.

Figure 7:
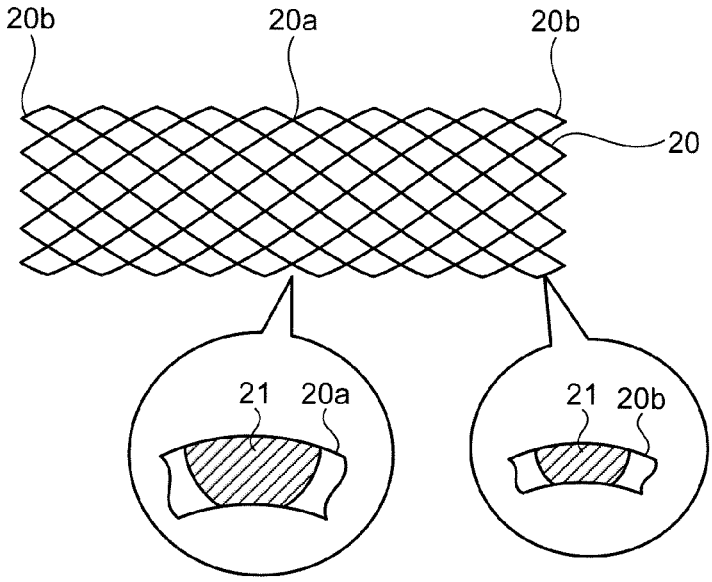
FIG. 7 is another enlarged vertical cross section of the main part of the stent that is manufactured by the manufacturing method according to the embodiment of the present invention.
Figure 8:
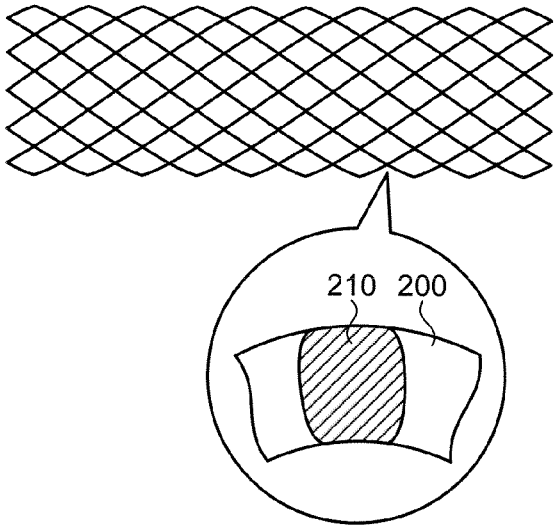
FIG. 8 is an explanatory diagram of a stent that is manufactured by a conventional manufacturing method and a main part of the stent.

Furthermore, because each of the first polishing process and the second polishing process described above includes a process of moving the magnetic poles 8 along the axial direction of the polishing container 4, a cross-sectional area of the stent 20 can be appropriately adjusted by changing a polishing time for each region to be polished, as illustrated in FIG. 7. More specifically, if a polishing time for both end portions of the stent base 10 is longer than a polishing time for the central portion of the stent base 10, it is possible to manufacture the stent 20 in which a cross-sectional area of a central portion 20*a* of the strut portion 21 is large while cross-sectional areas of both end portions 20*b* of the strut portion 21 are small.

The preferred embodiments of the present invention are explained above; however, the present invention is not limited to the above embodiments and various modifications may be made. For example, although the polishing container 4 rotates around the shaft center of the polishing container 4 in the above embodiment, according to the present invention, the magnetic poles may rotate around the central axis of the polishing container.

Furthermore, the above embodiment has been explained with an example in which the magnetic poles 8 are slightly reciprocated along the axial direction of the polishing container 4 in the first polishing process and the second polishing process; however, according to the present invention, the polishing container itself may be reciprocated, that is, oscillated, along the own axial direction.

Moreover, the magnetic poles 8 are slidable along the axial direction of the polishing container 4 in the above embodiment; however, according to the present invention, the polishing container may slide along the axial direction of the polishing container while the magnetic poles are relatively displaced with respect to a tubular base along the axial direction of the tubular base.

Furthermore, the process time of the second polishing process is longer than that of the first polishing process in the above embodiment; however, according to the present invention, the magnetic force may be appropriately changed in each polishing process.

INDUSTRIAL APPLICABILITY

As described above, the method of manufacturing the tubular structure according to the present invention is useful in manufacturing a tubular structure having a complicated shape, such as a stent.

REFERENCE SIGNS LIST

1 POLISHING APPARATUS
2 ABRASIVE PARTICLE TANK
3 PUMP
4 POLISHING CONTAINER
5 PIPE
6 ABRASIVE PARTICLE
7 MAGNETIC PARTICLE
8 MAGNETIC POLE
10 STENT BASE
11 ROD MEMBER
12 CYLINDRICAL MEMBER
20 STENT
21 STRUT PORTION

The invention claimed is:

1. A method of manufacturing a tubular structure by housing a tubular base, which has a side circumference surface formed in a bellows-like shape, in a polishing container, causing magnetic particles formed of a magnetic substance to flow along a circumferential direction of the tubular base by action of magnetic poles arranged outside the polishing container, and supplying abrasive particles formed of a non-magnetic substance to the polishing container by a supplying means arranged outside the polishing container so that the abrasive particles flow along an axial direction of the tubular base, thereby polishing a surface of the tubular base, the method comprising:

a first polishing step of polishing an exposed surface of the tubular base by causing the magnetic particles and the abrasive particles to flow while an inner surface of the tubular base remains covered; and a second polishing step of polishing an exposed surface of the tubular base by causing the magnetic particles and the abrasive particles to flow while an outer surface of the tubular base remains covered.

2. The method according to claim 1, wherein a polishing condition is changed between the first polishing step and the second polishing step.

3. The method according to claim 1, wherein a process time of the first polishing step is different from a process time of the second polishing step.

4. The method according to claim 1, wherein a magnetic force is generated by the magnetic poles, and a magnitude of the magnetic force generated by the magnetic poles in the first polishing step is different from a magnitude of the magnetic force generated by the magnetic poles in the second polishing step.

5. The method according to claim 1, wherein a process time of the second polishing step is longer than a process time of the first polishing step.

6. The method according to claim 1, wherein each of the first polishing step and the second polishing step includes a step of moving at least one of the magnetic poles and the polishing container while the magnetic poles are relatively displaced with respect to the tubular base along the axial direction of the tubular base.

7. The method according to claim 6, wherein, at each of the first polishing step and the second polishing step, a time taken to polish end portions of the tubular base by moving the magnetic poles to positions corresponding to the end portions is longer than a time taken to polish a central portion of the tubular base by moving the magnetic poles to a position corresponding to the central portion.

* * * * *